US011505875B2

(12) United States Patent
Schmidt

(10) Patent No.: US 11,505,875 B2
(45) Date of Patent: Nov. 22, 2022

(54) METHOD OF PROVIDING A COLOURED, ANODISED ALUMINIUM SURFACE

(71) Applicant: Bang & Olufsen A/S, Struer (DK)

(72) Inventor: Martin Schmidt, Viborg (DK)

(73) Assignee: Bang & Olufsen A/S, Struer (DK)

( * ) Notice: Subject to any disclaimer, the term of this patent is extended or adjusted under 35 U.S.C. 154(b) by 62 days.

(21) Appl. No.: 16/878,794

(22) Filed: May 20, 2020

(65) Prior Publication Data

US 2020/0370196 A1 Nov. 26, 2020

(30) Foreign Application Priority Data

May 21, 2019 (DK) ..... PA 2019 00603
Aug. 20, 2019 (DK) ..... PA 2019 00982

(51) Int. Cl.
*C25D 11/22* (2006.01)
*C25D 11/02* (2006.01)

(52) U.S. Cl.
CPC ..... *C25D 11/22* (2013.01); *C25D 11/022* (2013.01)

(58) Field of Classification Search
None
See application file for complete search history.

(56) References Cited

U.S. PATENT DOCUMENTS 5,419,829 A * 5/1995 Fisher ..... C25D 5/54 205/184
5,472,788 A * 12/1995 Benitez-Garriga .... C25D 11/12 205/174
2005/0109623 A1* 5/2005 Lee ..... C25D 11/12 205/52
2010/0051467 A1 3/2010 Tian et al.
2011/0017602 A1 1/2011 Khosla
2013/0008796 A1* 1/2013 Silverman ..... C25D 11/12 361/679.01
2013/0299357 A1 11/2013 Lai et al.
2014/0166490 A1* 6/2014 Tatebe ..... C25D 11/22 205/199
2015/0044436 A1 2/2015 Li
2015/0339564 A1* 11/2015 Herslow ..... C25D 7/00 235/488

FOREIGN PATENT DOCUMENTS

EP 2177647 A1 4/2010
GB 2567505 A 4/2019

OTHER PUBLICATIONS

Danish Search Report for Danish Patent application No. PA 2019 00982 dated Nov. 6, 2019.
Extended European Search Report dated Sep. 15, 2020 issued in corresponding European Appln. No. 20175703.6.

* cited by examiner

*Primary Examiner* — Wojciech Haske
(74) *Attorney, Agent, or Firm* — Harness, Dickey & Pierce, P.L.C.

(57) ABSTRACT

A method of providing a workpiece with an anodised aluminium surface with varying colour. The anodised surface is added colour, such as evenly, so that a colour concentration profile exists through the depth, where after a portion of the outer layer is removed to arrive at colour corresponding to a particular depth.

15 Claims, 1 Drawing Sheet

METHOD OF PROVIDING A COLOURED, ANODISED ALUMINIUM SURFACE

CROSS REFERENCE TO RELATED APPLICATIONS

This application claims priority to Danish Patent Application Nos. DK PA 2019 00603 filed on May 21, 2019, and DK PA 2019 00982 filed on Aug. 20, 2019, the entire contents of each of which are incorporated herein by reference.

BACKGROUND

The present invention relates to a method of providing an anodised aluminium surface with a gradual change in perceived colour, such as along one or more directions of the surface. Anodised aluminium is transparent or translucent and porous, so a colouring agent may be introduced therein and subsequently sealed therein to arrive at a coloured anodic layer.

In order to provide a gradual colour variation, as is often desired, of prior art elements, the colour variation must be provided in the porous surface layer prior to sealing.

SUMMARY

According to the invention, the gradual colour variation is introduced instead by creating a graduated thickness of the dyed anodised surface layer.

Anodising and the like may be used for architectural applications, household appliances, consumer electronics etc.

Relevant technology may be seen in US 2010/051467.

In a first aspect, the invention relates to a method according to claim 1.

In the present context, the aluminium surface may be any surface of a workpiece comprised of aluminium (Al). Preferably, the workpiece is made completely of aluminium or at least a portion thereof which is anodised is made at least substantially of aluminium before anodising.

Anodising transforms the surface of the metal to an oxide film, preferably with a selected thickness. This portion, before anodising, then preferably is of aluminium. Alternatively, titanium and other anodisable materials such as iron, zirconium, hafnium, vanadium, niobium and tantalum can be used for generating porous or open anodised surface areas.

Aluminium anodising is a known process which comprises exposing the surface to an electrolytic solution in the presence of a cathode, while under electrical current, to oxidize the surface. Any method of converting the outer portions of aluminium to porous aluminium oxide may be used. The usual porosity of anodised aluminium mostly consists of parallel pores perpendicular to the surface, arranged in a honeycomb pattern, but any porous aluminium oxide surface may be used as a basis for the present method.

A colour, dye or colouring agent is introduced into the porosity of the anodised surface layer. This may be achieved by exposing an anodised and porous aluminium oxide surface to a colouring agent in the form of a liquid, solution, suspension or powder, often resulting in a desired perceived colour. Methods of providing the colouring agent into the porosity and methods of obtaining different colour agent distributions or amounts in different depths are described further below.

The colour, dye or colouring agent may in principle be any type of powder, dye, liquid or the like. The colouring agent may be provided as a solution of organic or inorganic dyes, where there in either case may be one or several types of dye molecules present, as a solution of metal salts or a suspension, colloid or powder of particles. A dyeing solution could be an aqueous solution of organic dyes with a concentration of the dye molecules in the range of 0.02 to 20 g/L. Alternatively, instead of water, oil could be used as a solvent.

The introduction may be performed in a wet state where a liquid is already present in the porosity. The anodised and rinsed workpiece may be exposed to a liquid in which one or more colouring agents are present, such as in a solution or a suspension. In the case of organic dyeing, the dye molecules in the solution or suspension in contact with the porous oxide surface, will diffuse into the porosity of the surface. Subsequent to this, any potential excess of generally any desired amount of the colouring agent may be rinsed off by spraying with water, dipping in water or by blowing with air.

Alternatively, the introduction may be performed in a dry or at least substantially dry surface, such as by introducing into the porosity a liquid, solution or suspension or by introducing a dry colouring agent, such as a powder. In case of particles, either suspended in a liquid, gas or in the form of a powder, they must have dimensions smaller than that of the diameter of the pores in order to be able to enter the porosity of the anodic layer.

Subsequent to this introduction step, a step may be performed of closing or sealing the porosity to prevent loss of the colour from the workpiece. A step of this type may e.g. be exposure to hot water to convert the aluminium oxide into Boehmite. Another method of sealing the surface is pore-plugging, where the pores are closed by precipitating another substance inside them, e.g. nickel compounds. Alternatively, a transparent or translucent material may be added to the surface and/or into the porosity to seal the colouring agent inside the porosity.

The coloured, anodised surface has a first area of the outer surface. Within the first surface area, a second surface area is seen.

Subsequent to the introducing step, at least a portion of the coloured anodised surface layer is removed over at least 10%, such as over at least 15%, such as at least 20%, such as at least 25%, such as at least 50% of the first area of the coloured, anodised surface.

Often, it is desired that material is removed in a continuous surface portion, such as a portion with an area of at least 5%, such as at least 10%, such as at least 15%, of the coloured surface. Clearly, material may be removed to different depths over this area.

The second area may be all, or part, of the first area. The second area has a lower thickness than portions outside of the second area, such as a second thickness no more than 95% of the first thickness, such as no more than 90%, 80%, 70% or less. Thus, different thicknesses are seen. The reduced thickness is caused by the removing step. Preferably, the second area has at least substantially the same thickness as outside thereof before the removing step.

Clearly, if the anodised, coloured layer from the onset has different thicknesses, the amount of removed material may determine the colour variation. In this situation, the invention would instead relate to removing different amounts of material (removing a different thickness) in the two areas.

The removal may comprise removing a thickness of 1-30 μm, such as 2-10 μm. It may be desired that over an area of at least 5% of the first area, at least 1 μm is removed, such as at least 2 μm, such as at least 5 μm, such as at least 8 μm.

It may be desired to remove no less than 2%, such as at least 5%, such as at least 10%, such as at least 20% of the total depth of the anodised layer. On the other hand, it may be desired to not remove too much material in order to not lose time during production.

Removing, at any given position or section of a coloured and anodised surface, a portion of the coloured anodised surface layer, thereby reducing the thickness of it, will result in the removal of a portion of the amount of colouring agent present in said surface layer. As aluminium oxide is transparent or translucent, this will mean that the integrated colour seen at the surface at that given surface position or section, will appear lighter compared to other positions or sections where no portions of the surface layer have been removed.

As aluminium oxide is transparent or translucent, the colour in the layer may be visible throughout the complete depth depending on the amount of dye. If a lot of dye is present in the oxide layer, the aluminium surface will not be visible, since all of the transmitted light will then be absorbed completely before reflecting at the oxide-aluminium interface. Even if the colouring agent was evenly distributed inside the anodised layer, removing a portion thereof will still result in a change in the observed colour at the surface.

It may be desired that the removal step comprises removing the portion over no more than 80% of the first area. Thus, it is ensured that varying amounts of material are removed from the surface. Thus, different thicknesses of the material are removed or allowed to remain.

Usually, it is desired that the anodised layer has a uniform thickness before removal. Thus, after removal, the layer thickness may be lower at the positions where material has been removed. Clearly, colour gradients may be obtained by providing variations in layer thickness. If a gradually larger layer thickness is removed, a gradually lighter or more aluminium-coloured surface is obtained.

It may be preferred that the anodised surface layer has a thickness of at least 8 μm. Anodised layers are often used for providing aluminium workpieces with a resistant surface—such as scratch and corrosion resistant. Often, the anodised layer may be desired thicker, such as at least 15 μm thick, such as 15-30 μm thick.

It is noted that the amount of material, such as the thickness of the portion of the anodised layer removed, may be selected based on the concentration or distribution of the colouring agent in the anodised layer. If the concentration is very high at a certain depth, it may not be possible to see the colour at larger depths, whereas if the concentration is lower, the colouring all the way to the bottom of the anodised layer or the bottom of the colour material distribution inside the anodised layer may be visible.

Thus, the depth to which it is desired to remove material, depending on the desired outcome, may depend heavily on the amount of colouring agent added and the concentration thereof in the depth direction of the anodised layer.

It may be desired to provide a homogeneous colour over the surface of the anodised surface layer. In this situation, homogeneous would mean that at least substantially the same colour concentration is seen in the depth direction over the surface of the coloured surface.

Naturally, the removal step may be performed in any desired manner, such as sanding, sand blasting, polishing, brushing, and/or buffing of the surface.

It may be desired to use a method which removes small portions at a time, as the layer thickness of the material to be removed may be very limited, typically in the order of a few μm. Thus, using a coarse sand paper would bring about a very uneven removal—which naturally could be intended—but which would normally not be desired.

Especially when material is removed over a continuous area, the removing step may comprise operating a removal tool on the portion of the coloured anodised layer. Thus, when a larger thickness of the material is to be removed, the tool may be operated for a longer period of time, at a higher force, at higher revolutions, or the like. Naturally, different thicknesses may alternatively be removed using the same parameters but with different coarseness, such as grain size of an abrasive medium, the amount of abrasive paste or the hardness of the tool.

As mentioned, it may be desired that the colouring agent or material is introduced into the anodised layer with a homogeneous concentration also in the depth direction.

Alternatively, the introducing step may comprise introducing the colouring agent with a lower concentration at larger depths in the anodised surface layer than at shallower depths. In this way, a relatively larger percentage of the total amount of colouring agent in the depth direction may be removed when removing the outermost portions of the layer. Thus, less material need be removed to arrive at a desired, light colour.

Because the removal step may be time consuming, as it preferably is performed using rather gentle methods, it may be desired to speed up the process by limiting the amount of material to remove. This can be achieved by limiting the penetration depth of the colouring agent such that a larger quantity is found nearer to the surface. Then, less material needs to be removed before a change in colour can be perceived.

In one situation, the introducing step comprises limiting the colouring agent from diffusing into the deepest portions of the anodised surface layer. In this way it is possible to remove essentially all of the colour, by removing the coloured portion of the oxide film, while still retaining a satisfactory thickness of oxide film after the removal process. As mentioned above, it is desired to have an anodised surface as it provides scratch resistance and corrosion resistance to the aluminium workpiece. Removing a layer with a thickness so large that virtually all of the colouring agent is removed also gives the largest possible colour contrast on the coloured surface.

In one embodiment, the introduction step comprises forming, in the anodised surface layer, a maximum concentration of the colouring agent and where, in the first surface part, a concentration of no more than 10% of the maximum concentration exists at a depth of more than 15 μm from the surface. In this manner, removal of the top 15 μm will remove at least 90% of the colouring agent. Clearly, the maximum depth of no more than 15 μm could be no more than 20 μm or no more than 10 μm or even no more than 8 μm or no more than 5 μm. If a large colour contrast is desired while not wanting to remove a lot of material, it may be desired that as much as possible of the colouring agent is positioned as close to the surface as possible. On the other hand, this also increases the sensitivity to small variations during the removal step, which makes it more difficult to achieve a homogeneous and continuous result.

In one embodiment, the introducing step comprises adding the colouring agent as an aqueous solution. Alternatively, the colouring agent could be a liquid or powder. The colouring agent could be added by dipping the workpiece or the surface part in the colouring agent, by spraying and/or brush painting the colouring agent onto the surface.

Naturally, further steps may be performed to ensure that sufficient amounts of colouring agent enter the porosity of the anodised surface layer or a desired depth in the porosity. For example, the surface part and/or colouring agent may be heated/chilled, or a non-ambient pressure may be applied before, during or after application of the colouring agent. Adding vacuum, such as when the colouring agent is introduced into a dry or at least substantially dry layer, before application will allow subsequent ambient pressure to force the colouring agent further into the porosity.

Also, the period of time allowed for the diffusion into the porosity will aid in the definition of the resulting colouring and distribution within the layer.

Another method of adapting the concentration profile of the colouring agent in the depth direction of the surface part is to, after adding the colouring agent to the surface, remove excess colouring agent from the surface but perhaps also from the outer portions of the porosity. This removal may be obtained by washing the surface or wiping the surface to remove colouring agent which has not penetrated into the porosity or which is only weakly adsorbed onto the outermost portions of the porosity.

In one embodiment, the introducing step comprises:

initially adding a first colouring agent into the porosity, subsequently adding a second colouring agent into the porosity.

A number of effects may be obtained with this method. If both colouring agents are present in the same relative concentration in the porosity, the combined colour will be the result.

As mentioned before the overall colour of a surface part is the integral of all colouring throughout the depth of the porosity.

However, if different relative concentrations of the two colouring agents vary, such as along the depth direction, removing an outer layer may comprise removing a relatively larger proportion of one colour leaving predominantly the other colour. Thus, the removal of the outer portions creates a change in the overall colour, colour tone and/or colour shade.

When adding the first colouring agent, this colouring agent will diffuse into the porosity where it adheres or settles and thus reduces the porosity of the surface part. Thus, the second colouring agent will experience a reduced porosity, affecting the capacity for adsorption for the second colouring agent. This may be taken into account when selecting the colouring agents. For example, the second colouring agent may be selected with a higher viscosity in order to better flow through the reduced porosity. Alternatively, a separate material, such as molecules or particles, may be introduced into the porosity to adsorb or settle a predetermined distance into the porosity to prevent the second colouring agent from moving further into the porosity. As mentioned earlier, a higher or lower pressure may also be used to assist or prevent diffusion of a colouring agent in the form of a dry powder or a suspension of particles into the porosity.

Clearly, any desired concentration variation inside the porosity may be arrived at.

A second aspect of the invention relates to a workpiece according to claim 11.

This workpiece may have been manufactured using the method of the first aspect of the invention.

Clearly, all embodiments and situations of the first aspect are equally relevant in relation to this second aspect of the invention.

In this context, the workpiece may be an aluminium workpiece or a workpiece having an aluminium surface which has been anodised. Anodised aluminium is an oxidized surface which, most importantly, is porous, so that the colouring agent is able to diffuse or move into the depth of the layer.

The surface of the workpiece may have any number of surface parts. The first and second surface parts may form all of or only a part of the surface of the anodised surface. Preferably, the first and second surface parts are, respectively, continuous surface areas.

Each of the first and second surface parts take up at least 10% of the area of the anodised surface. Naturally, one or both of these surface parts may take up at least 15%, such as at least 20%, 25%, 30%, 40%, 50% or more of the anodised surface area.

The first surface part has a first amount of a predetermined colouring agent per unit of area. In this context, the unit area is an area on the surface of the first surface part. The first amount of colouring agent may, especially when the colouring agent is provided in a concentration sufficiently low for the lowest portions thereof to be visible or discernible, be the amount of the colouring agent across the depth of the anodised layer. Alternatively, the amount of colouring agent may be that of up to a predetermined depth in the layer, such as when present in a sufficiently large concentration so that only the colouring agent in the outermost portions of the layer are visible.

Alternatively, the first surface part has a unit area on the surface and a volume underneath extending to the bottom of the anodic film, defined as the unit of area on the surface integrated to the bottom of the anodic film. In this first volume there is a first predetermined total amount, i.e. summarized amount, of colouring agent.

The same is the situation for the second surface part, where the total amount of colouring agent in the volume will be less than for the first surface part.

In general, the amount of colouring agent per unit of area refers to an amount of colouring agent inside the anodised layer from the surface of the layer to a certain depth of the layer, underneath that unit of area.

The colouring agent may be evenly distributed or not.

The first surface part has a first thickness of the anodised surface layer. This thickness may be an average thickness or a minimum thickness if desired.

The second surface part has a second thickness of the anodised surface layer. This thickness may be an average thickness or a maximum thickness if desired.

When the first amount is at least 1.1 times, such as 1.2 times, such as 1.5 times, such as at least 1.75 times, such as 2 times, such as 2.5 times, such as 3 times, such as 4 times, such as 5 times the second amount, different amounts of colouring agent may be present and/or visible. Thus, different colours may be seen in the two surface areas.

Also, the first thickness is at least 1.1 times, such as 1.2 times, such as 1.5 times, such as at least 1.75 times, such as 2 times, such as 2.5 times, such as 3 times, such as 4 times, such as 5 times the second thickness. Thus, the colour difference may be created by the method of the first aspect of the invention.

It may be desired that the amount of colouring agent of the first surface part at depths below the second thickness is the same as the second amount so that from the bottom of the anodised layer and until the height of the surface of the second surface part, the first and second surface parts have at least substantially the same amount of colouring agent.

Then, the difference in colouring agent is, in the first surface part, that between this height and the surface of the first surface part.

The concentration as a function of distance of the colouring agents in the first and second surface parts may be the same from the bottom of the anodised layer and until the height of the surface of the second surface part. This, however, is not required.

In one embodiment, the anodised surface layer has a thickness of at least 8 μm, such as at least 10 μm, such as 15-30 μm. The thickness of the layer may be the, typically average, depth of the porosity or channels in the material.

In one embodiment, in the first surface part, the concentration of the colouring agent is lower at larger depths in the anodised surface layer than at smaller depths. Then, less material need be removed from the outside to arrive at a desired colour change.

In one embodiment, the workpiece has a maximum amount of the colouring agent and where, in the first surface part, an amount of no more than 10% of the maximum amount exists at a depth of no more than 15 μm from the surface. As mentioned above, this may be preferred to more easily obtain large colour differences or contrasts.

In one embodiment, the concentration of colouring agent is at least substantially zero in the deepest portions of the anodised surface layer. In this manner, all of the colouring agent may be removed, to obtain a maximum contrast, while still retaining an anodised surface.

Another aspect of the invention relates to another method of obtaining a variation in an anodised surface.

Some materials may also be anodised to create a non-porous oxide film, such as iron, titanium, zirconium, hafnium, niobium and tantalum. Titanium may be anodised to create a transparent or translucent titanium oxide film on the surface, also known as an anodic layer or film. This anodic film is usually non-porous. However, it is still possible to obtain various surface colours, the apparent colour being a result of interference between the light reflected at the air-film interface and the light reflected at the film-titanium interface. Depending on the film thickness different wavelengths of light will either completely or to a lesser extent cancel out. If the film thickness is in the range of ½ to 2 times the wavelength of visible light, the light interference will create colours in the visible light spectrum.

In this context, a non-porous layer is a layer having a porosity causing 5% or less, such as 1% or less of its volume to be voids or channels.

Then, the removal of a portion of the layer thickness may result in a change in apparent colour.

Then, anodising may be performed to arrive at a layer thickness in the range of the wavelength of visible light. Clearly, the initial layer thickness may be larger, such that no colour is visible before the removal process, so that a removal step may provide the desired largest layer thickness resulting in a desired colour. Subsequent to this, a portion of the layer, such as at least 10% of the area thereof, may have a portion of the thickness removed to arrive at another layer thickness and thus another apparent colour.

Yet an aspect of the invention may be a workpiece with an anodised surface, which preferably is at least substantially non-porous, and which has two areas with different anodised layer thicknesses. The thickness difference may be 1% or more, such as 5% or 10% or more.

Preferably, the layer thickness is in the order of ½ to 2 times the wavelength of visible light.

BRIEF DESCRIPTION OF THE DRAWINGS

In the following, preferred embodiments of the invention will be described with reference to the drawing, wherein.

DETAILED DESCRIPTION

Figure 1:
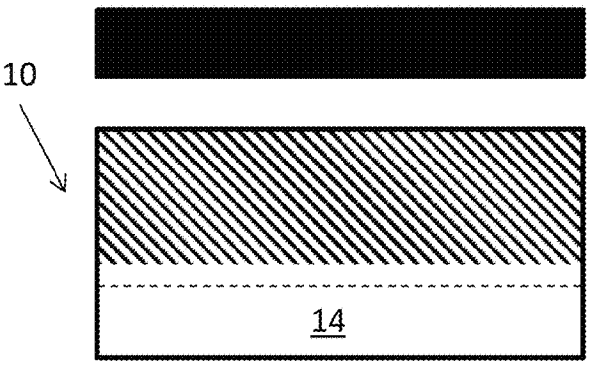
FIG. 1 illustrates a coloured, anodised surface.

In FIG. 1, a cross-section of a workpiece 10 with an anodised surface layer 12 extending a predetermined depth under which the aluminium material 14 is seen. The anodised layer 12 has been dyed or coloured with a colouring agent which is provided in the pores of the anodised layer 12.

The colouring agent concentration may be more or less constant through the anodised layer 12. Alternatively, the colour agent concentration may exhibit a variation in the concentration from a higher concentration at the top portion (air interface) than at larger depths.

In this embodiment, it is seen that the lowest portion 13 of the anodised surface layer 12 has not received any colouring agent or has received no discernible portion thereof. This has the advantage that the colour of the underlying material 14 may be obtained while still retaining a portion of the anodic film, retaining the surface properties of the anodised layer 12.

Figure 3:
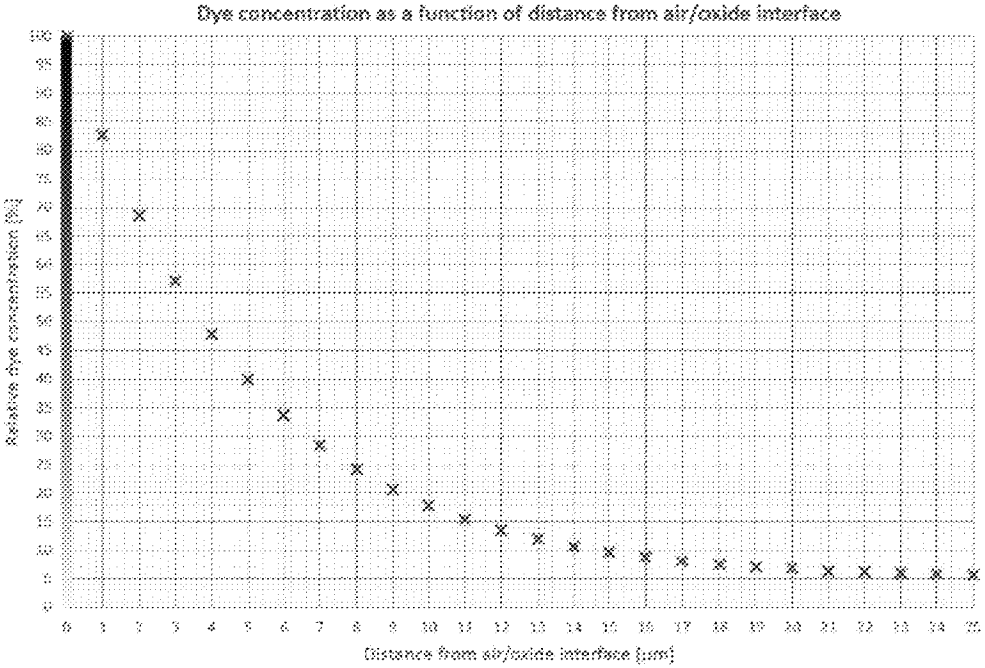
FIG. 3 illustrates the relative dye concentration in a workpiece seen in FIG. 1.

An example of the dye or colour concentration as a function of the depth from the upper surface may be seen in FIG. 3.

Figure 2:
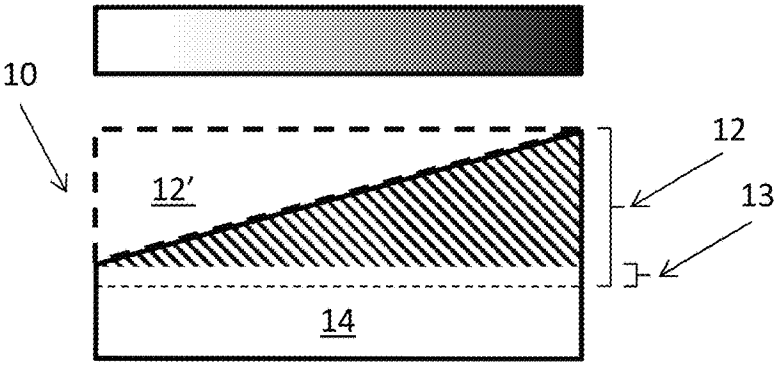
FIG. 2 illustrates the surface of FIG. 1 with a portion thereof removed.

In FIG. 2, the workpiece 10 of FIG. 1 has been exposed to mechanical processing by which a portion of the anodised surface layer 12, the portion 12' surrounded by the dashed line, has been removed, and hence also the dye that was imbedded within it. After this process it is seen that, as the anodic layer 12 is transparent or translucent, at the surface, different shades of colour are visible at different positions of the surface. An item will be lighter at one position because the sum of dye is smaller, and not necessarily because the concentration is lower at the surface. It is noted again that the colour at a position is the sum of the dye molecules in the depth direction. Thus, a surface with a colour gradient is obtained.

It is noted that the anodised material in itself is transparent or translucent so that the colour obtained at a given position of the surface of the workpiece 10 is an integration or sum of the colour through the layer in the thickness direction.

In the upper portions of FIGS. 1 and 2, the apparent colour is illustrated.

The workpiece 10 may be obtained using any of the known anodising techniques, such as exposure to an acid and a current. Anodising increases the strength of the surface and protects the aluminium against corrosion but also opens the surface creating a porosity consisting mainly of parallel pores, perpendicular to the surface, arranged in a hexagonal pattern. This porosity may be utilized to dye or colour the surface, as is well known.

Introducing a colour or dye onto or into the surface, such as by dipping, spraying or painting, will allow a portion of the colour or dye to enter into the anodised surface layer 12. Subsequently, the surface may be closed by e.g. turning the anodised layer into Boehmite by dipping into hot water, making the anodised material swell to a degree where the colour material is trapped in the swelled material.

As mentioned, it may be desired that the colour or die is introduced into the anodised layer with a decreasing concentration in the depth direction. This concentration distribution or function of the colour agent in the layer may be adapted or defined in a number of ways. It is known that the pore size of an anodised surface may be defined by process parameters, such as the voltage applied, and the time spent during the oxidation step of anodising. Also, the actual depth of the anodised layer may be defined by these process parameters.

In the same manner, the penetration of the dye or colouring agent into the porous anodic layer may be defined or controlled, such as by selecting a colour or dye with a larger or smaller molecule size in a more or less viscous liquid, by dyeing at a higher or lower temperatures, at higher or lower dye or colour agent concentrations and even with a lower or higher pressure and flow.

Having now provided a material with colouring agent in its porosity, e.g. dye, pigments, particles etc., portions of the layer may be removed to arrive at a workpiece 10 where portions of the outer surface is lighter in appearance and/or with a different hue/tone (less colouring agent and with larger colour contribution from the underlying material—typically Aluminium), corresponding to lesser amount of colouring agent because said colouring agent has been removed by a post-anodising process.

It may be desired to have the thickness of the anodic layer portion in which colour resides be rather thin, i.e. that the colour has not penetrated too far into the anodised material. In this way, the work required to remove a majority of the perceived colour, such as to arrive at a colour close to that of Aluminium, will be smaller than if the colouring agent had reached deeper into the anodic film.

Removal of the material 12' may be performed in any desired manner. Milling, sanding, sand blasting or the like may be used. Preferably, the anodised layer has a thickness of 15-30 μm, so that a rather gentle process may be used which does not remove too much material too swiftly. Polishing, for example, may be used.

It may be desired that the lowest or deepest layer 13 of the anodised material does not receive any colour or only an insignificant amount of colour, so that all of the coloured material may be removed to arrive at the colour of the anodised aluminium—while the remaining oxide layer has at least a minimum thickness such that satisfactory surface protection is retained.

Clearly, it would be possible to introduce multiple dyes into the anodised layer. A gradual change from one perceived colour at a specific location on the surface to another perceived colour at another location on the surface is then possible if the two or more different colouring agents, dyes or colours, have reached different depths within the anodised layer. The original colour perceived when looking at the original anodised and dyed surface will be a mix of the dyes used. Removing an increasing amount of oxide from the top will remove an increasing amount of the colouring agent at the outermost portions and thus reveal an increasingly larger proportion of the colouring agent that penetrated deepest into the oxide.

If the anodised and porous surface is exposed to a mix of dyes, by dipping or colouring, consisting of molecules with large differences in their ability to diffuse and/or bind, those dye molecules with highest binding affinity and highest rates of diffusion will penetrate deepest into the oxide. The molecule size difference can also be exploited: larger dye molecules will likely diffuse at different rates compared to smaller molecules, reaching different depths in the anodic film.

Another method could be to first dye with one dye for a prolonged time achieving a relatively deep penetration and then dye with a second dye for a shorter time, achieving a mix of dyes near the air-oxide interface with a larger proportion of the first dye at greater depths. Rinsing between the two dyeing steps, so as to remove at least a portion of the first dye at the outermost layers, could help achieve a better layering of dyes.

A third method could be to use electrolytic colouring first which forces the inorganic dye molecules into the bottom of the pores and subsequently dyeing with organic dye molecules. The penetration depth of the latter is, as previously mentioned, controlled by diffusion, and hence the organic dye molecules will not reach as deep as the electrolytic colouring, depending on the dye solution concentration, temperature and exposure time.

A colouring agent may alternatively be allowed to enter farther into the porosity if an increased pressure is used for forcing the colour into the porosity, or if the temperature is higher, often lowering the viscosity, for example. In addition, as the colouring of the porosity often is an adsorption of colouring agent in the porous structure, the porosity may itself be lowered when the second colour is to be introduced into the structure, which in itself would act to prevent the second colour from reaching as deeply into the structure.

Then, the first colour, defining a decrease in porosity, may act to inhibit or make difficult the introduction of the second colour to a depth past that in which the first colour is left.

The invention claimed is:

1. A method of colouring an aluminium surface, the method comprising:

anodising the aluminium surface to create an anodised surface layer, introducing a particular colouring agent into a porosity of the anodised surface layer to create a coloured anodised surface layer, the coloured anodised surface layer having a first area, removing at least a portion of the coloured anodised surface layer over a second area of at least 10% of the first area of the coloured anodised surface layer so that, outside of the second area, the coloured anodised surface layer has a first thickness and, within the second area, the coloured anodised surface layer has a second thickness being lower than the first thickness, characterized in that the removing step comprises retaining at least a portion of a thickness of the coloured anodised surface layer that includes the particular colouring agent over the second area, such that the particular colouring agent is present in both the first thickness of the coloured anodised surface layer outside of the second area, and the second thickness of the coloured anodised surface layer within the second area.

2. A method according to claim 1, wherein the removing step comprises removing the portion over no more than 80% of the first area.

3. A method according to claim 1, wherein the coloured anodised surface layer has a thickness of at least 8 μm.

4. A method according to claim 1, wherein the removing step comprises one or more of sanding, sand blasting, polishing, brushing, and/or buffing of a surface of the coloured anodised surface layer.

5. A method according to claim 1, wherein the removing step comprises operating a removal tool on the portion of the coloured anodised surface layer.

6. A method according to claim 1, wherein the introducing step comprises introducing the particular colouring agent with a lower concentration thereof at larger depths in the anodised surface layer than at lower depths.

7. A method according to claim 1, wherein the introducing step comprises not introducing the particular colouring agent to a deepest portion of the anodised surface layer.

8. A method according to claim 1, wherein the introducing step comprises forming, in the coloured anodised surface layer, a maximum concentration of the particular colouring agent and where, in the first area, a concentration of no more than 10% of the maximum concentration exists at a depth of more than 15 μm from a surface of the coloured anodised surface layer.

9. A method according to claim 1, wherein the introducing step comprises adding the particular colouring agent as a fluid.

10. A method according to claim 1, wherein the introducing step comprises:

initially adding a first colouring agent into the porosity, subsequently adding a second colouring agent into the porosity.

11. A workpiece having an anodised aluminium surface having a first surface part and a second surface part, wherein:

the first surface part takes up at least 10% of an area of the anodised aluminium surface, the anodised aluminium surface having, at the first surface part, a first amount of a particular colouring agent per unit of area and a first thickness of the anodised aluminium surface, the second surface part takes up at least 10% of the area of the anodised aluminium surface, the anodised aluminium surface having, at the second surface part, a second amount of the aluminium colouring agent per unit of area and a second thickness of the anodised aluminium surface, and the first amount is at least 1.1 times the second amount, and the first thickness is at least 1.1 times the second thickness, characterized in that the second surface part has anodised layer thereon, wherein the particular colouring agent is present in both the first thickness the anodised aluminium surface in the first surface part, and the second thickness the anodised a aluminium surface in the second surface part.

12. A workpiece according to claim 11, wherein the anodised aluminium surface has a thickness of at least 8 μm.

13. A workpiece according to claim 11, wherein, in the first surface part, the particular colouring agent has a lower concentration thereof at larger depths in the anodised aluminium surface than at lower depths.

14. A workpiece according to claim 11, having a maximum amount of the particular colouring agent and where, in the first surface part, an amount of no more than 10% of the maximum amount exists at a depth of no more than 15 μm from a surface of the anodised aluminium surface.

15. A workpiece according to claim 11, wherein a concentration of the particular colouring agent is zero in a deepest portion of the anodised aluminium surface.

* * * * *